US005901770A

United States Patent [19]

Belpaume et al.

[11] Patent Number: 5,901,770

[45] Date of Patent: May 11, 1999

[54] FLEXIBLE CLOSURE COVER WHICH CAN BE ROLLED ONTO AND UNROLLED FROM A ROTATABLE SUPPORT, PARTICULARLY FOR COVERING AN OUTSIDE SWIMMING POOL

[75] Inventors: Charles Belpaume, Bâtiment "Le Véronèse", 16 rue Marie-Louise, Sainte Anne, 13008 Marseille; Michel De Cavel, Villeneuve de Riviere, both of France

[73] Assignee: Charles Belpaume, Marseilles, France

[21] Appl. No.: 08/141,967

[22] Filed: Oct. 28, 1993

[30] Foreign Application Priority Data

Oct. 28, 1992 [FR] France ..... 92 12884

[51] Int. Cl.[6] ..... E06B 9/08

[52] U.S. Cl. ..... 160/133; 160/230; 160/232; 4/502

[58] Field of Search ..... 160/230, 133, 160/231.1, 231.2, 264, 23.1, 32, 33, 232, 236; 4/502, 498, 499, 500, 501

[56] References Cited

U.S. PATENT DOCUMENTS

| | | | |
|---|---|---|---|
| 3,019,450 | 2/1962 | Karasiewicz | 160/133 X |
| 3,072,920 | 1/1963 | Yellott | 4/498 X |
| 3,683,428 | 8/1972 | Morris | 4/498 |
| 4,028,750 | 6/1977 | Gustafsson | 4/498 |
| 4,037,639 | 7/1977 | Jones | 160/133 |
| 4,328,930 | 5/1982 | Kalendovsky | 4/498 X |
| 4,535,828 | 8/1985 | Brockhaus | 160/84.1 C |
| 4,577,352 | 3/1986 | Gautheron | 4/499 |
| 4,628,549 | 12/1986 | Lazar | 4/498 |
| 4,709,688 | 12/1987 | Paradis | 4/502 X |
| 5,107,552 | 4/1992 | Lavalliere et al. | 4/502 |

FOREIGN PATENT DOCUMENTS

| | | |
|---|---|---|
| 0225862 | 6/1987 | European Pat. Off. . |
| 2644500 | 9/1990 | France . |
| 7202370 | 6/1972 | Germany . |
| 7405636 | 8/1974 | Germany . |
| 2835046 | 2/1980 | Germany . |
| 8007192 | 7/1980 | Germany . |
| 2944105 | 7/1981 | Germany . |
| 3605029 | 8/1987 | Germany . |
| 4101727 | 7/1992 | Germany . |

*Primary Examiner*—David M. Purol
*Attorney, Agent, or Firm*—William R. Hinds; William H. Holt

[57] ABSTRACT

A flexible cover, which can be rolled onto and about a support rotatable about an axis, and can be unrolled therefrom, consists of at least one translucent sheet having: a continuous outside wall extending throughout the width and throughout the length of the sheet, the length being the dimension which is parallel to the rotational axis of the support and the rolling and unrolling axis of the sheet; a discontinuous inside wall parallel to the outside wall and extending throughout the length and, in a discontinuous interrupted manner, the width of the sheet; and parallel longitudinal walls, extending throughout the length of the sheet, perpendicularly to and connecting the outside and inside walls to define groups of successive longitudinal cells, interruptions of the inside wall defining spaces between respective pairs of adjacent groups of successive cells, the groups being separate and being connected solely by the outside wall which, at the interruptions at the inside wall, constitutes a flexure portion for rolling and unrolling of the sheet onto and off the support. The cover is applicable to the closure of an outside swimming pool or a balcony.

19 Claims, 3 Drawing Sheets

FLEXIBLE CLOSURE COVER WHICH CAN BE ROLLED ONTO AND UNROLLED FROM A ROTATABLE SUPPORT, PARTICULARLY FOR COVERING AN OUTSIDE SWIMMING POOL

FIELD OF THE INVENTION

The present invention relates to a flexible closure cover which, when it is not deployed in a use position, can be retracted by rolling up, generally on a barrel.

The invention is applicable in particular, but in a non-limitative manner, to covering an outside swimming pool by such a flexible cover, which then rests on the surface of the water of the swimming pool when the latter is not being used.

Another application of the invention is for closing balconies, particularly during winter time.

BACKGROUND AND PRIOR ART

In the preferred application of the invention to an outside swimming pool cover, various techniques are already known.

A first technique consists of using a simple sheet which comprises an impermeable layer held at the surface of the water by floats or by cords provided from place to place; another technique derived from the previous one consists of incorporating in this sheet a sort of air bag by means of very thin bubbles which ensure floatation another technique again consists in using floating leaves which are assembled together in the manner of a roller shutter.

None of these known techniques gives complete satisfaction. In fact these techniques are either expensive, or need delicate operations for the deployment and retraction of the cover, or are ineffective as regards maintaining the temperature of the water.

SUMMARY OF THE INVENTION

The object of the invention is to remedy these inconveniences in proposing a flexible cover which is inexpensive, easy to handle and above all has a notably improved efficiency in maintaining the temperature of the water.

For this, the flexible cover according to the invention, able to be rolled on a support, consists of at least one translucent sheet comprising: a continuous outside wall extending throughout the width and throughout the length of the cover, the length of the sheet being defined as the dimension which is parallel to the rolling up axis of the support; a discontinuous inside wall, parallel to the outside wall and extending throughout the length and, in a discontinuous manner, the width of the sheet; and parallel longitudinal walls, extending throughout the length of the sheet, perpendicularly to the outside and inside walls connecting them to define groups of successive longitudinal cells, two adjacent groups of successive cells being separated by a space resulting from an interruption of the inside wall and being connected solely by the outside wall which, in this zone, constitutes a flexure portion for rolling of the sheet on the support.

The outside wall, which advantageously receives a covering for interrupting ultraviolet rays, defines the outside surface for rolling up on the support.

The cells are generally filled with air, which particularly permits the passage of the sun's rays and, in the preferred application to swimming pool covers, the floatation of the cover.

Advantageously, the material used for the sheet constituting the flexible cover is rigid polycarbonate.

This piece is obtained either by extrusion in its final form, or by extrusion of a sheet of which the inside wall is continuous, the said extrusion then being followed by an operation of local removal of portions of the inside wall for defining respectively the groups of longitudinal cells and the longitudinal spaces.

In practice, the cover consists of a plurality of sheets which are successively joined along their lengths, either mechanically or adhesively.

Advantageously, the cover has, for example at the end of the joint zone of two successive sheets, guides projecting beyond the sheets for co-operating by sliding with the structure against which the cover is applied.

In particular, in the preferred application of the invention to swimming pool covers, the cells are blocked at their ends particularly to avoid ingress of water, this blocking being for example made with a silicone mastic.

Also in this particular application, the sheet which is furthest from the rolling up barrel has a longitudinal part which is inclined upwards for forming a sort of ski or skate blade during the placing of the cover on the water.

In another application of the invention in which the flexible cover is intended to constitute a balcony closure, able to be rolled up on an upper horizontal barrel, the continuous outside wall of the cover defines the outside surface of this closure. When deployed the flexible cover can be either vertical or inclined to the horizontal at an angle which generally will be between 30° and 90°. Advantageously the flexible cover will then be guided laterally in U-shaped guides which will adequately ensure its stability against to wind.

BRIEF DESCRIPTION OF THE DRAWING

The invention will be better understood from reading the rest of the description which follows and with reference to the accompanying drawings which form part of the description and in which.

DESCRIPTION OF PREFERRED EMBODIMENT

Figure 1:
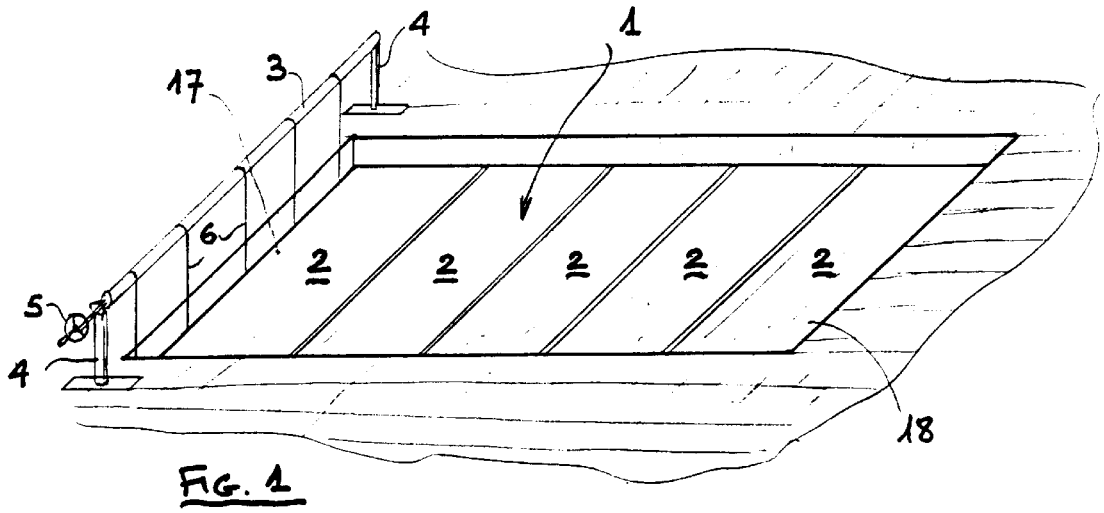
FIG. 1 is a schematic perspective view of a cover according to a preferred embodiment of the invention in its application to a cover for an outside swimming pool.

There is shown in FIG. 1, in perspective, use of the flexible cover according to the invention in its preferred application to a cover for an outside swimming pool.

The cover 1 in accordance with the invention consists of a plurality of rectangular sheets 2, five sheets in the example considered, which are joined edge to edge along their lengths.

The cover 1 is dimensioned to be able to occupy substantially all the surface of the water and it can be rolled up on a support of the horizontal barrel type 3 provided at an end of the length of the swimming pool, at an appropriate height. The length of each sheet 2 is defined as that of its two dimensions which is parallel to the rolling up axis of the barrel 3.

This barrel 3 is mounted on vertical supports 4 and is driven by any appropriate means, for example by a motor or more simply by hand, with the aid of a crank handle 5.

Cords 6 are fixed at one end on the barrel 3 and at the other end on the longitudinal edge of the first sheet 2.

The structure of the sheets 2 will now be described with reference to FIGS. 2 and 3.

Each sheet 2 is translucent, or indeed transparent, and it advantageously consists of rigid polycarbonate or similar material having excellent properties of mechanical resistance, particularly to shocks, and resistance to ageing, particularly to yellowing, to weathering and to degradation of its structure. Each sheet will have a width of approximately two meters, which is the usual commercial width, and it will be cut to a length which is slightly less 30 than the width of the swimming pool to be equipped with it.

The translucent sheet 2 has an outside continuous wall 7 which extends throughout the width and the length of the sheet, and an inside discontinuous wall 8, which is parallel to the wall 7 and which extends throughout the length and, in a discontinuous manner, throughout the width of the sheet and parallel longitudinal walls 9, which extend throughout the length of the sheet, perpendicularly to the outside 7 and inside 8 walls connecting them to define successive groups of longitudinal cells 10, two successive adjacent groups of cells being separated by a space 11 resulting from interruption of the inside wall 8 and being connected only by the outside wall 7 which, in this zone, constitutes a flexure portion for the sheet for the rolling up of the latter on its support, for example the barrel 3 of FIG. 1.

In the application of FIG. 1, the outside wall 7 defines the upper surface of the cover directly exposed to the rays of the sun, whilst the inside wall 8 defines the lower surface of the cover which is contact with the water.

On rolling up, the outside or upper wall 7 constitutes the outside rolling up surface on the support 3.

Advantageously, the outside wall 7 carries a covering for interrupting ultraviolet rays, this covering comprising for example a coating.

The sheet 2 is thus comprised of a succession of groups 19 of cells, these groups 19 being separated by longitudinal spaces 11 and connected only by the outside wall 7.

This structure confers to the sheet good rigidity both in its plane and perpendicularly to this plane, due to the presence of the groups of spaced cells, but also a flexibility in the connection zones for the groups of cells, this flexibility permitting the rolling up on the barrel.

The cells 10 are advantageously filled with air, which facilitates the passage of the sun's rays for heating the water, permitting the floatation of the sheet and ensuring a correct thermal insulation.

In particular, in the preferred application to a swimming pool cover, and in general to avoid the penetration of any foreign matter into the cells 10, for example dust, leaves or small animals, the ends of the cells are blocked, as shown at 12, these blockings being for example of silicone mastic.

Figure 4:
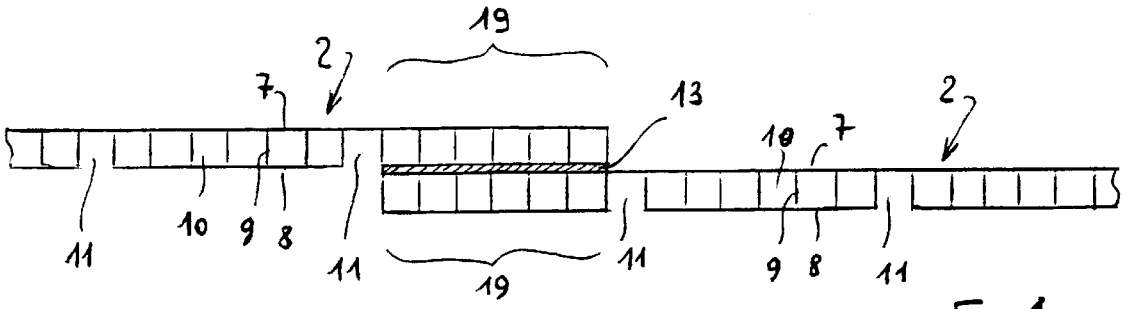
FIG. 4 is a transverse cross-section showing the joining together of two sheets.
Figure 5:
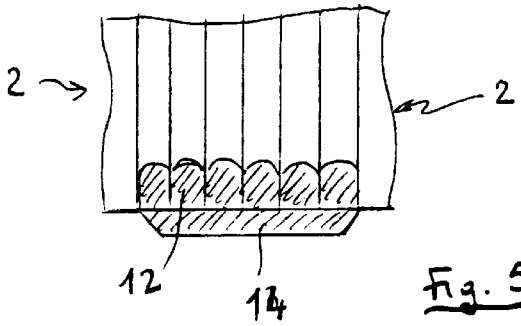
FIG. 5 is a top view of part of the joined sheets of FIG. 4.

The sheets 2 are joined edge to edge along their lengths in any appropriate manner, for example mechanically or adhesively as shown in FIG. 4. For adhesively joining, the adjacent longitudinal edges of two successive sheets are superimposed, these two edges having groups 19 which have the same number of cells 10 and these two edges are facially glued, for example with a glue 13 of the neoprene contact type which has the advantage of resisting humidity, of being colorless and of having great resistance to separation.

In accordance with an advantageous characteristic of the invention, there can be added locally to the sheets 2, for example in the joint zones of two successive sheets 2, guides 14 which project beyond the sheets for constituting sliding skates cooperating with the walls of the structure on which the cover is applied, these walls being in the two applications envisaged either the vertical longitudinal walls of the swimming pool or the walls of the balcony of the building.

Figure 6:
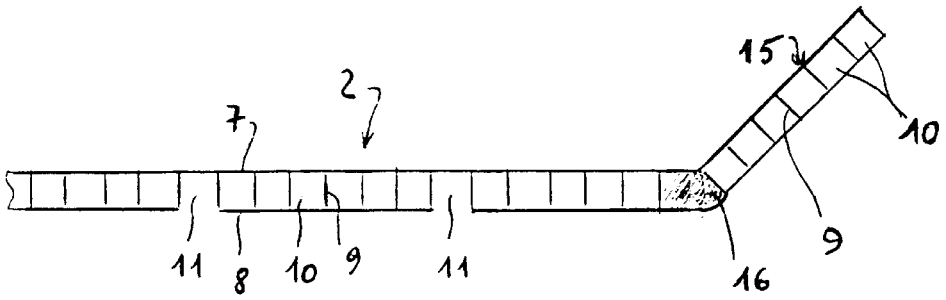
FIG. 6 is a transverse cross-section showing the end of the sheet furthest from the rolling up barrel, still in the application of the cover to an outside swimming pool cover.

FIG. 6 illustrates another advantageous characteristic of the invention, usable in its application to a swimming pool cover.

According to this characteristic the sheet 2 furthest from the rolling up barrel 3 has a longitudinal part 15 which is inclined upwards to form a sort of ski or skate blade during the placing of the cover on the water.

This inclined part, for example at 45°, is obtained by longitudinally splitting the lower wall 8, bending the end of the sheet by deformation towards the outside of the outside wall 7 and placing a wedge 16, for example a thick cord of silicone mastic, in the trapezoidal rectangular space thus created.

Figure 2:
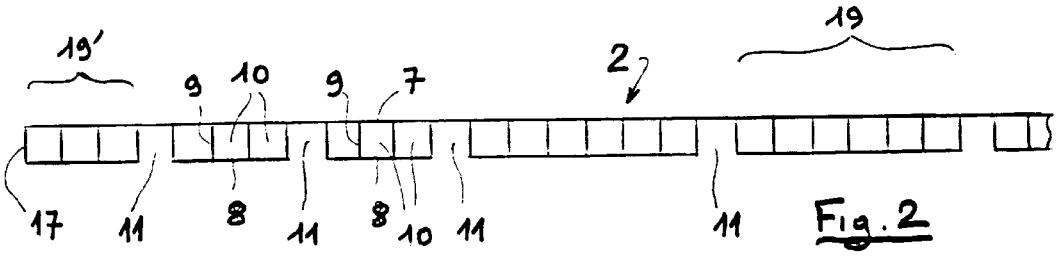
FIG. 2 is a transverse cross-section of one of the sheets forming the cover of FIG. 1.
Figure 3:
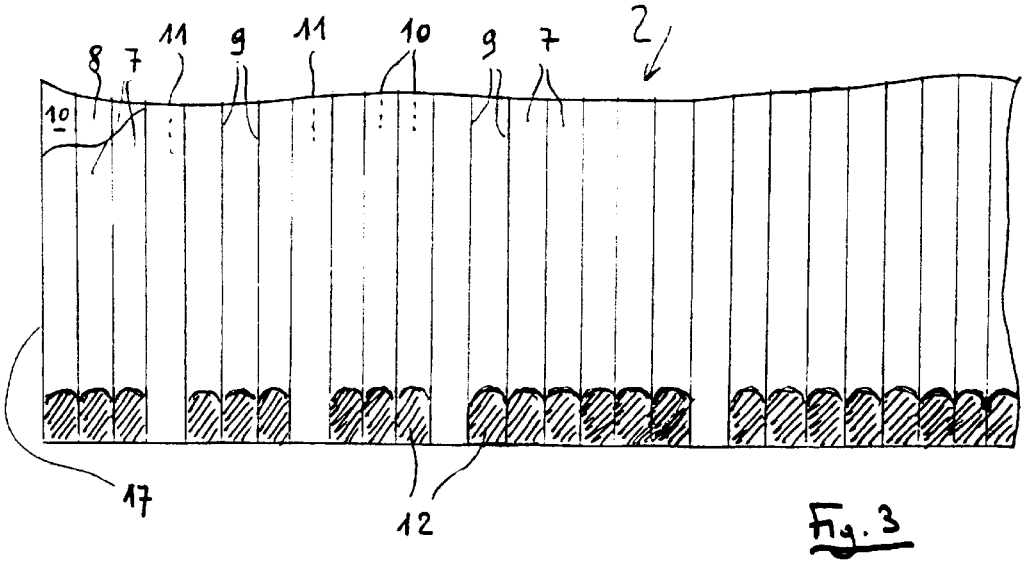
FIG. 3 is a view from above of a part of the sheet of FIG. 2.

Advantageously, to avoid excessive flexure stresses on the outside wall 7 of the sheet 2 next to the barrel 3, the first sheet as illustrated in FIGS. 2 and 3, has, at least in its part which cooperates first with the barrel 3 groups 19' of cells 10 of a lesser number than the number of cells in the following groups 19.

For example the first groups 19' can have two or three cells whilst the following groups 19 can have for example five cells. The pitch in accordance with which the longitudinal spaces 11 are thus formed increases from the edge 17 of the sheet closest to the rolling up barrel towards the end 18 of the sheet furthest from the barrel.

Each sheet constituting the cover in accordance with the invention can be obtained either by extrusion to its final cross-section, such as shown in FIG. 2, or by extrusion of a sheet of which the inside wall 8 is continuous, this extrusion then being followed by machining during which longitudinal bands in this wall 8 are locally removed to define the spaces 11.

The sheet 2 can be made of any desired thickness, for example from 6 mm to 32 mm. As mentioned, it is advantageously made of cellular polycarbonate, this material having the further advantages of ensuring 82% luminous transmission, of being easily treated against ultraviolet rays, and of being of low density thus of excellent floatation due to the air trapped in the cells closed by the blocks of silicone mastic.

Figure 7:
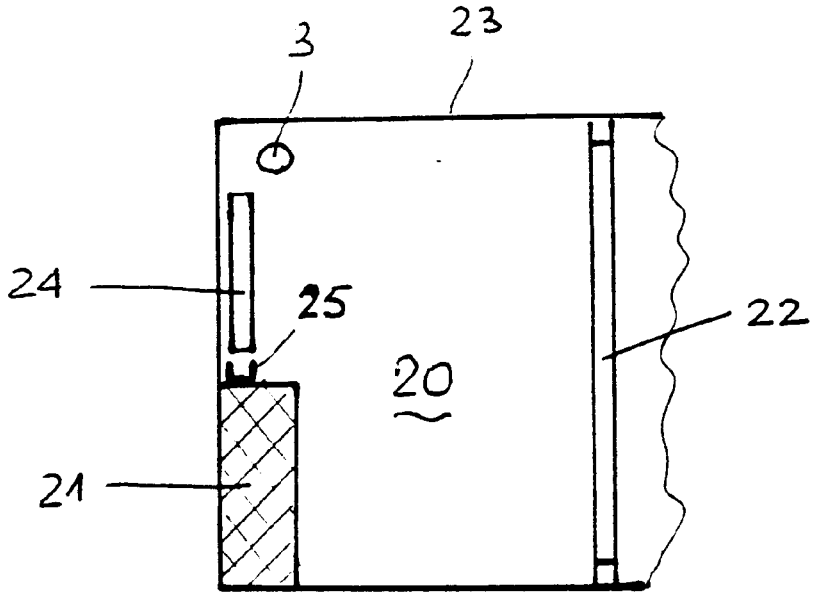
FIGS. 7 and 8 are schematic side views of a cover according to the invention in its application to a balcony closure able to be rolled up, the cover being able to be deployed respectively vertically and inclined to the horizontal at an angle of approximately 45°.
Figure 8:
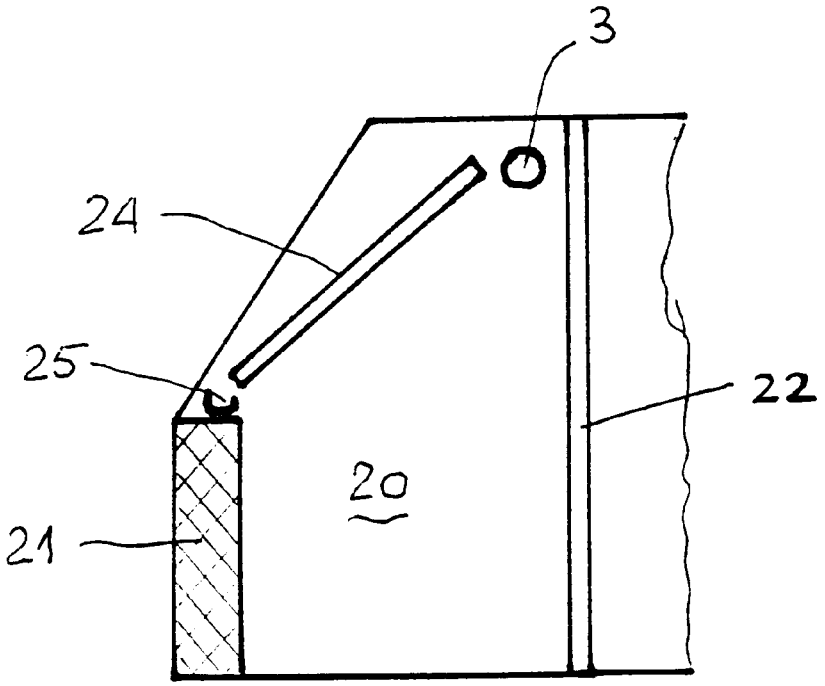
Figure 1:
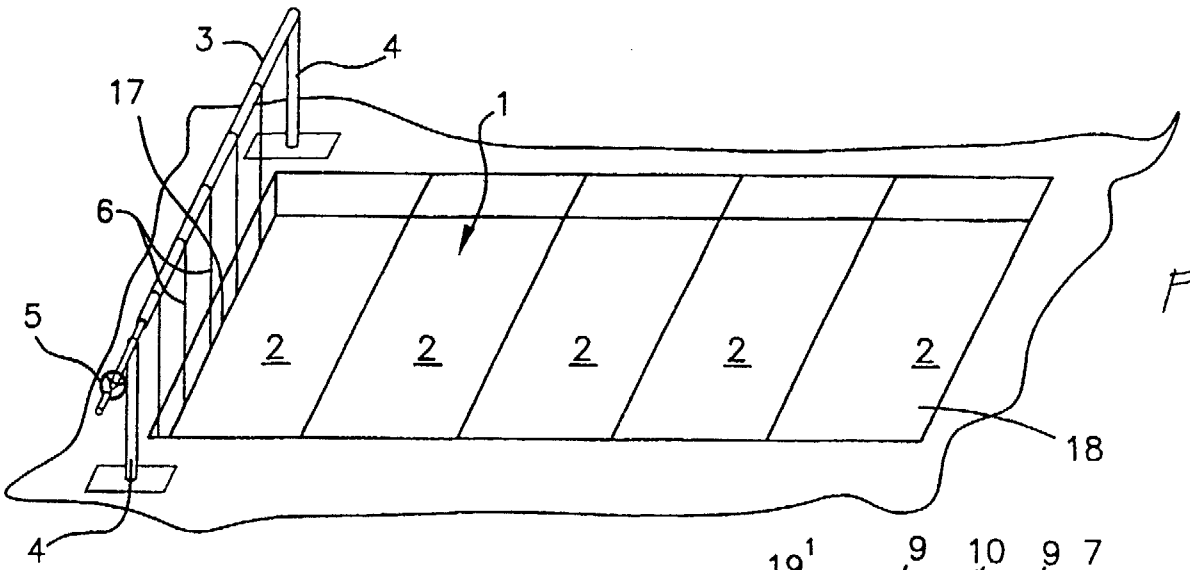
Figure 2:
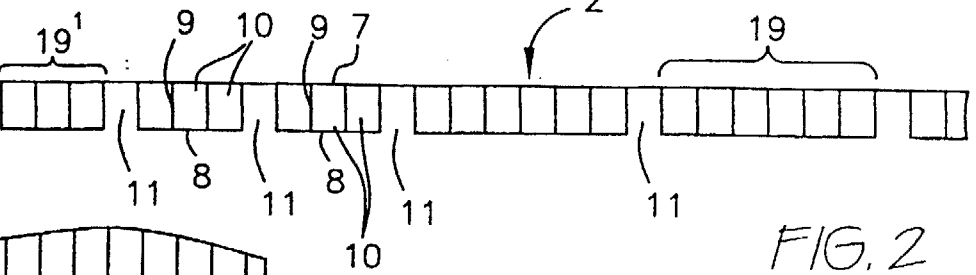
Figure 3:
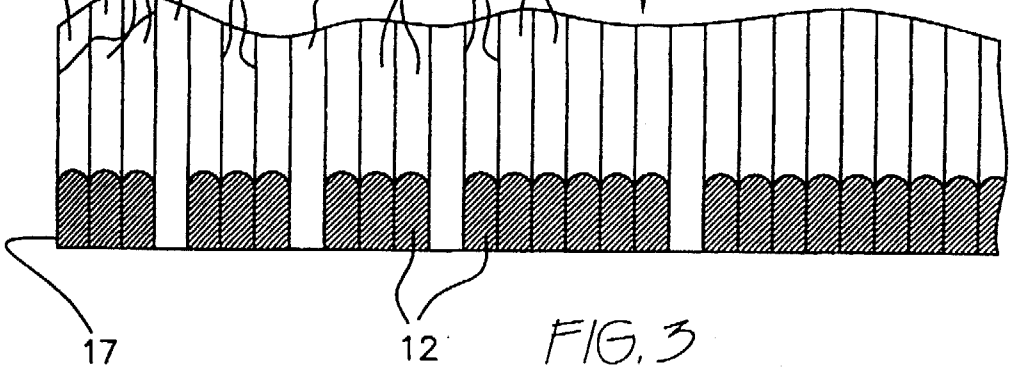
Figure 4:
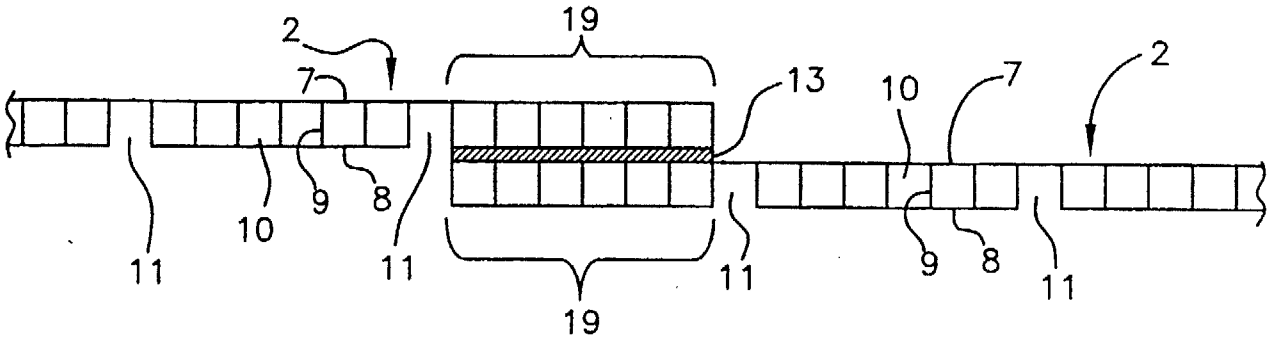
Figure 5:
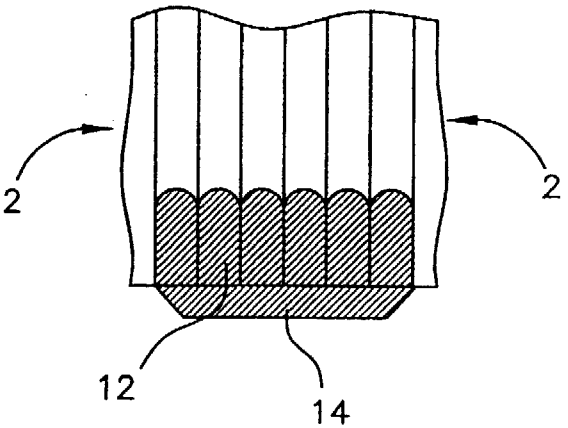
Figure 6:
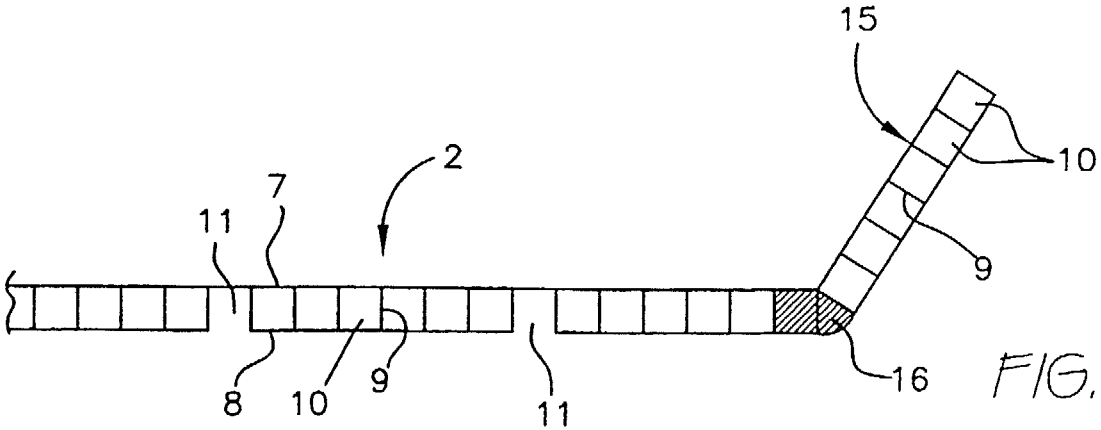
Figure 7:
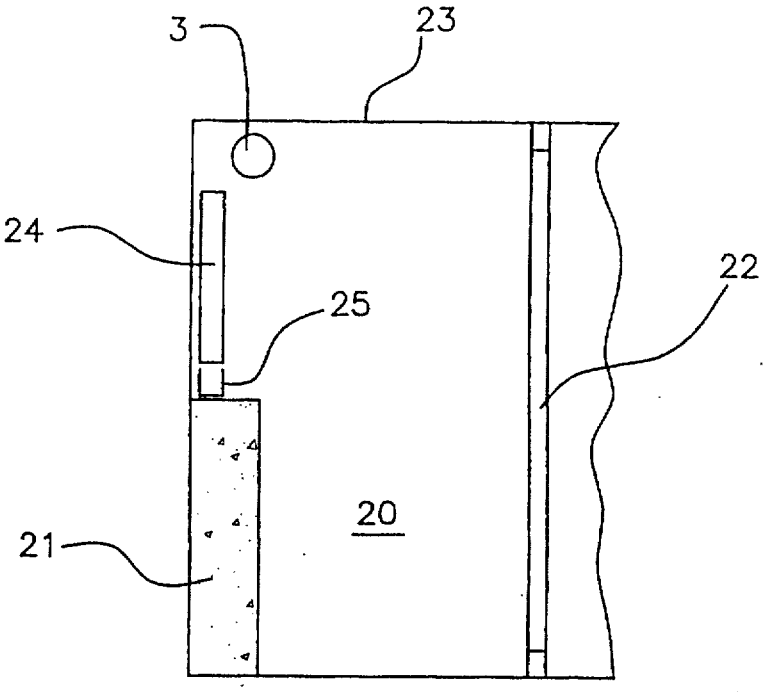
Figure 8:
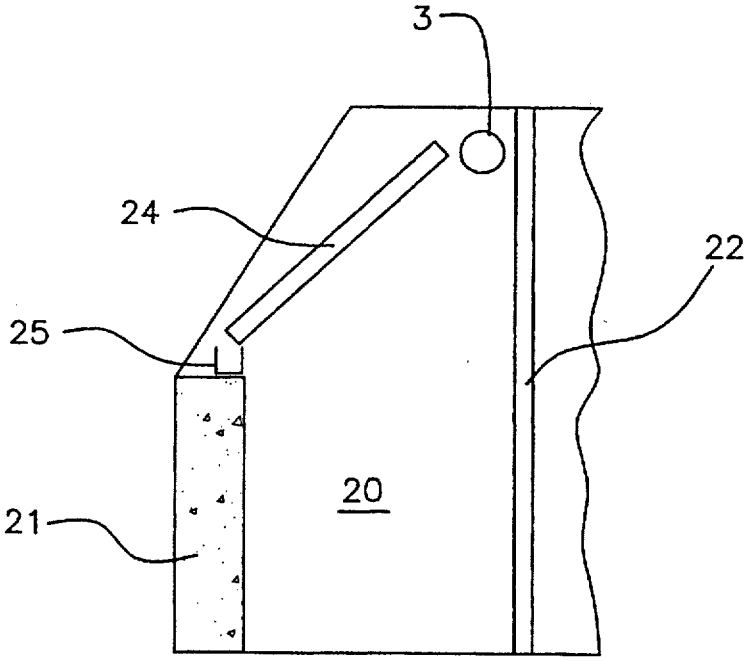

In its application to a closure for a balcony 20 comprising for example a ballustrade 21 and a sliding french window 22, the cover 1 such as described above made of one or more sheets 2 as a function of the width of the balcony 20, will be able to be deployed either vertically if the balcony is closed at its upper part by a canopy 23 (FIG. 7), or at an inclination to the horizontal if the balcony is open to the sky (FIG. 8). As the case may be, the barrel 3 will then be arranged below the canopy vertically above the balustrade 21 (FIG. 7) or above the french window 22 (FIG. 8).

Advantageously, to facilitate deployment of the cover and also to stabilize the cover after its deployment, particularly against wind, the two longitudinal edges of the cover will be guided in slides 24 of U-shaped cross-section, fixed to the flanking walls either vertically (FIG. 7) or at the desired inclination (FIG. 8). A third U guide 25, fixed to the balustrade, will be able to receive the lateral edge of the cover deployed furthest from the barrel 3.

Of course the invention is not limited to the embodiment nor to the methods of application which have been described; it will be possible on the contrary to conceive diverse variants without departing from its scope.

For example an intermediary wall will be able to be provided between the end walls 7 and 8, interrupted locally, as with the inside wall 8, to provide the spaces 11 permitting flexure of the sheet for its rolling up.

We claim:

1. A flexible cover, which can be rolled onto and about a support rotatable about an axis, and can be unrolled therefrom, consisting of at least one translucent sheet comprising:

a continuous outside wall extending throughout the width and throughout the length of said sheet, said length of said sheet being defined as the one of these two dimensions which is parallel to the rotational axis of said support and the rolling and unrolling axis of the sheet;

a discontinuous inside wall, parallel to said outside wall and extending throughout the length and, in a discontinuous interrupted manner, the width of said sheet; and parallel longitudinal walls, extending throughout said length of said sheet, perpendicularly to and connecting said outside and inside walls to define groups of successive longitudinal cells, interruptions of said inside wall defining spaces between respective pairs of adjacent groups of successive cells, said groups being separate and being connected solely by said outside wall which, at said interruptions in said inside wall, constitutes a flexure portion for rolling and unrolling of said sheet onto and off said support.

2. A cover according to claim 1, wherein said outside wall defines an outside surface for rolling up on said support.

3. A cover according to claim 1, wherein said outside wall has a covering for interrupting ultraviolet rays.

4. A cover according to claim 1, wherein said cells are filled with air.

5. A cover according to claim 1, wherein said sheet consists of rigid polycarbonate.

6. A cover according to claim 1, comprising a plurality of sheets successively joined along their length.

7. A cover according to claim 6, wherein said sheets are joined mechanically.

8. A cover according to claim 6, wherein said sheets are joined adhesively.

9. A cover according to claim 8, wherein said adhesively joined sheets are facially joined.

10. A cover according to claim 6 comprising guides projecting longitudinally beyond said sheets, at an end of a joint zone of two successive sheets, for slidingly cooperating with a structure against which said cover is mounted.

11. A cover according to claim 1, wherein said cells are blocked at their ends.

12. A cover according to claim 11, wherein said cells are blocked at their ends by silicone mastic.

13. A cover according to claim 1, wherein the distance between said spaces increases from and end of said cover closer to said support towards an end of said cover further from said support.

14. A cover according to claim 1, wherein each sheet is obtained by extrusion in its final form.

15. A cover according to claim 1, wherein each sheet is obtained by extrusion of a sheet of which said inside wall is continuous, said extrusion being then followed by an operation of local removal of portions of said inside wall for defining respectively said longitudinal spaces and said groups of longitudinal cells.

16. A cover according to claim 1, constituting a horizontal cover for an outside swimming pool, which can be rolled up on a barrel placed outside an edge of the swimming pool, said outside continuous wall of said cover defining an upper surface of said cover.

17. A cover according to claim 16, wherein one of said sheets furthest from said rolling up barrel has a longitudinal part inclined upwards to function as a ski or skate blade to facilitate placing of said cover onto water in said swimming pool.

18. A cover according to claim 1, constituting a closure for a balcony, which can be rolled up on an upper horizontal barrel, said continuous outside wall of said cover defining an outside surface of said closure.

19. A cover according to claim 18, including U-shaped guides for guiding the cover at least laterally, said guides being fixed in use to a structure at which said cover is to be deployed.

* * * * *

UNITED STATES PATENT AND TRADEMARK OFFICE

CERTIFICATE OF CORRECTION

PATENT NO. : 5,901,770
DATED : May 11, 1999
INVENTOR(S) : Charles Belpaume, et al It is certified that error appears in the above-identified patent and that said Letters Patent is hereby corrected as shown below:

The title page, showing the illustrative figure, should be deleted and substitute therefor the attached title page.

The drawing sheets, consisting of Figs. 1-8, should be deleted to be replaced with the drawing sheets, consisting of Figs. 1-8, as shown on the attached pages.

Signed and Sealed this

Twenty-third Day of November, 1999

*Attest:*

Q. TODD DICKINSON

*Attesting Officer*

*Acting Commissioner of Patents and Trademarks*

US005901770A

United States Patent [19]

Belpaume et al.

[11] Patent Number: 5,901,770

[45] Date of Patent: May 11, 1999

[54] FLEXIBLE CLOSURE COVER WHICH CAN BE ROLLED ONTO AND UNROLLED FROM A ROTATABLE SUPPORT, PARTICULARLY FOR COVERING AN OUTSIDE SWIMMING POOL

[75] Inventors: Charles Belpaume, Bâtiment "Le Véronèse", 16 rue Marie-Louise, Sainte Anne, 13008 Marseille; Michel De Cavel, Villeneuve de Riviere, both of France

[73] Assignee: Charles Belpaume, Marseilles, France

[21] Appl. No.: 08/141,967

[22] Filed: Oct. 28, 1993

[30] Foreign Application Priority Data

Oct. 28, 1992 [FR] France ..... 92 12884

[51] Int. Cl.[6] ..... E06B 9/08

[52] U.S. Cl. ..... 160/133; 160/230; 160/232; 4/502

[58] Field of Search ..... 160/230, 133, 160/231.1, 231.2, 264, 23.1, 32, 33, 232, 236; 4/502, 498, 499, 500, 501

[56] References Cited

U.S. PATENT DOCUMENTS

| | | | |
|---|---|---|---|
| 3,019,450 | 2/1962 | Karasiewicz | 160/133 X |
| 3,072,920 | 1/1963 | Yellott | 4/498 X |
| 3,683,428 | 8/1972 | Morris | 4/498 |
| 4,028,750 | 6/1977 | Gustafsson | 4/498 |
| 4,037,639 | 7/1977 | Jones | 160/133 |
| 4,328,930 | 5/1982 | Kalendovsky | 4/498 X |
| 4,535,828 | 8/1985 | Brockhaus | 160/84.1 C |
| 4,577,352 | 3/1986 | Gautheron | 4/499 |
| 4,628,549 | 12/1986 | Lazar | 4/498 |
| 4,709,688 | 12/1987 | Paradis | 4/502 X |
| 5,107,552 | 4/1992 | Lavalliere et al. | 4/502 |

FOREIGN PATENT DOCUMENTS

| | | |
|---|---|---|
| 0225862 | 6/1987 | European Pat. Off. . |
| 2644500 | 9/1990 | France . |
| 7202370 | 6/1972 | Germany . |
| 7405636 | 8/1974 | Germany . |
| 2835046 | 2/1980 | Germany . |
| 8007192 | 7/1980 | Germany . |
| 2944105 | 7/1981 | Germany . |
| 3605029 | 8/1987 | Germany . |
| 4101727 | 7/1992 | Germany . |

*Primary Examiner*—David M. Purol

*Attorney, Agent, or Firm*—William R. Hinds; William H. Holt

[57] ABSTRACT

A flexible cover, which can be rolled onto and about a support rotatable about an axis, and can be unrolled therefrom, consists of at least one translucent sheet having: a continuous outside wall extending throughout the width and throughout the length of the sheet, the length being the dimension which is parallel to the rotational axis of the support and the rolling and unrolling axis of the sheet; a discontinuous inside wall parallel to the outside wall and extending throughout the length and, in a discontinuous interrupted manner, the width of the sheet; and parallel longitudinal walls, extending throughout the length of the sheet, perpendicularly to and connecting the outside and inside walls to define groups of successive longitudinal cells, interruptions of the inside wall defining spaces between respective pairs of adjacent groups of successive cells, the groups being separate and being connected solely by the outside wall which, at the interruptions at the inside wall, constitutes a flexure portion for rolling and unrolling of the sheet onto and off the support. The cover is applicable to the closure of an outside swimming pool or a balcony.

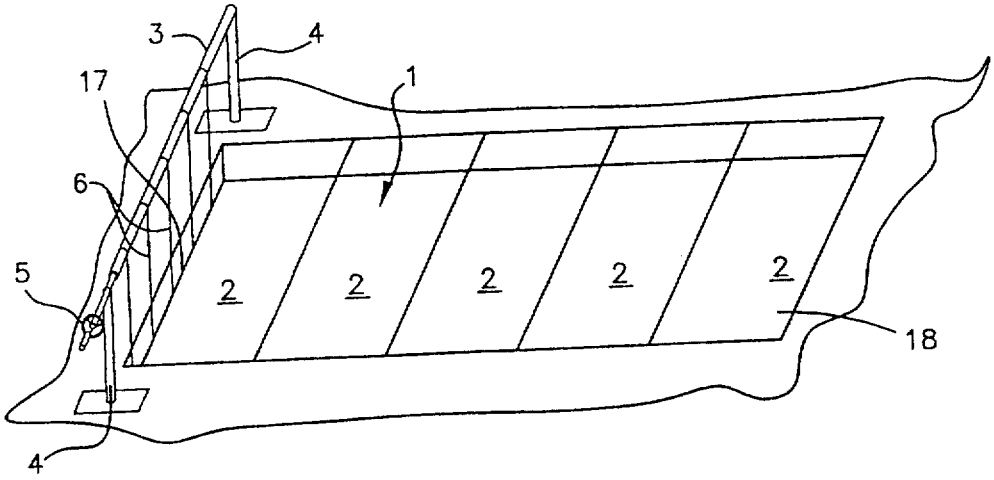

19 Claims, 3 Drawing Sheets